US008142104B2

(12) United States Patent
Mercer et al.

(10) Patent No.: US 8,142,104 B2
(45) Date of Patent: Mar. 27, 2012

(54) DOWEL SLEEVES

(75) Inventors: John Mercer, Evans Head (AU); Mark Anthony Connolly, Casino (AU)

(73) Assignee: Connolly Key Joint Pty. Ltd., Casino, New South Wales (AU)

( * ) Notice: Subject to any disclaimer, the term of this patent is extended or adjusted under 35 U.S.C. 154(b) by 0 days.

(21) Appl. No.: 13/135,142

(22) Filed: Jun. 27, 2011

(65) Prior Publication Data

US 2011/0255920 A1 Oct. 20, 2011

Related U.S. Application Data

(62) Division of application No. 12/587,192, filed on Oct. 2, 2009, now Pat. No. 7,967,528.

(30) Foreign Application Priority Data

Oct. 3, 2008 (AU) ..... 2008905163

(51) Int. Cl.
*E01C 11/00* (2006.01)

(52) U.S. Cl. ..... 404/136; 404/134; 404/135

(58) Field of Classification Search ..... 404/43–63, 404/134–136
See application file for complete search history.

(56) References Cited

U.S. PATENT DOCUMENTS

| | | | | | |
|---|---|---|---|---|---|
| 2,158,953 | A * | 5/1939 | Wilcox | 404/60 |
| 2,193,129 | A * | 3/1940 | Geyer et al. | 404/63 |
| 2,208,000 | A * | 7/1940 | Geyer | 404/2 |
| 2,325,472 | A * | 7/1943 | Brickman | 404/60 |
| 3,279,335 | A * | 10/1966 | Garner | 404/62 |
| 3,437,018 | A | 4/1969 | Jackson | |
| 4,648,739 | A * | 3/1987 | Thomsen | 404/2 |
| 5,216,862 | A | 6/1993 | Shaw et al. | |
| 5,487,249 | A | 1/1996 | Shaw et al. | |
| 5,618,125 | A | 4/1997 | McPhee et al. | |
| 5,797,231 | A * | 8/1998 | Kramer | 52/396.02 |
| 5,941,045 | A | 8/1999 | Plehanoff et al. | |
| 6,502,359 | B1 | 1/2003 | Rambo | |
| 6,692,184 | B1 * | 2/2004 | Kelly et al. | 404/52 |
| 7,201,535 | B2 * | 4/2007 | Kramer | 404/52 |
| 7,441,984 | B2 * | 10/2008 | Kramer | 404/52 |

* cited by examiner

*Primary Examiner* — Raymond W Addie
(74) *Attorney, Agent, or Firm* — Hudak, Shunk & Farine Co. LPA

(57) ABSTRACT

A support leg for a dowel sleeve, the dowel sleeve having a hollow open body at a second end spaced from one end of the body connectable to a construction plate. The support leg has a spigot engagable in the body, the exterior of which is engaged by an abutment face. The effective length of the support leg is adjustable by selectively detaching one or more leg member segments, each provided with a disc-like base member.

9 Claims, 7 Drawing Sheets

DOWEL SLEEVES

CROSS REFERENCE TO RELATED APPLICATIONS

This application is a divisional application based on co-pending U.S. patent application Ser. No. 12/587,192, filed Oct. 2, 2009 for DOWEL SLEEVES, which claims priority to Australian Application AU 2008905163 filed Oct. 3, 2008.

BACKGROUND OF THE INVENTION

1. Field of the Invention

THIS INVENTION relates to dowel sleeves.

In particular, the invention relates, but is not limited to, dowel sleeves for the construction of concrete slabs; and to parts or components for the dowel sleeves.

Throughout the specification, the term "construction plate" shall be used to include key joint plates, contraction plates and expansion plates for the construction of concrete slabs; and like construction plates used in building construction.

2. Prior Art

Dowel sleeves, which are typically of circular or rectangular cross-section, are commonly used to accommodate expansion and/or contraction of adjacent concrete slabs at a joint, where one end of each dowel is "locked" into one of the concrete slabs and the other end is slidably received within a respective dowel sleeve to allow controlled lateral movement, relative to the joint, between adjacent concrete slabs in a generally horizontal direction (i.e. along an axis substantially perpendicular to the joint between the adjacent slabs; but limiting any horizontal (or lateral) movement (i.e., along an axis parallel to the joint) and/or any vertical displacement between the adjacent concrete slabs.

Typically, the prior art dowel sleeves are formed from plastics material (which may have been wholly- or partially-recycled); where one end (i.e., the outer end) of the dowel sleeve is fixed, e.g., by nailing to a material (which may have been wholly- or partially-recycled); where one end (i.e., the outer end) of the dowel sleeve is fixed, e.g., by nailing to a construction plate, and the other end is supported by an integral leg or a "chair", to locate the dowel sleeve before the concrete is poured for the concrete slab in which at least a portion of the dowel sleeve is to be embedded.

The one (or outer) end may be engaged with an end cap, of complementary external shape, nailed or otherwise fixed to the construction plate.

Alternatively, the one (or outer) end of the dowel sleeve may be engaged in complementary formation(s) on the construction plate.

The workers installing the dowel sleeves must align each with respective holes through the construction plate, where the dowels extend through the holes; fix the one (or outer) ends of the dowel sleeves to the construction plate; and align and support the dowel sleeves so that they will not be displaced prior to/during the concrete pour to ensure the designed (or allowable) relative expansion/contraction movement between the slabs can be achieved without unwanted horizontal (lateral) and/or vertical displacement between the adjacent concrete slabs.

SUMMARY OF THE PRESENT INVENTION

It is an object of the present invention to minimise, or at least ameliorate, the location and/or securing of dowel sleeves to a building construction plate (as hereinbefore defined).

It is a preferred object of the present invention to provide a method for quick, accurate mounting of the one (or inner) ends of dowel sleeves to a construction plate.

It is a further preferred object of the present invention to provide efficient and effective support for the second (or outer) ends of the dowel sleeves.

It is a further preferred object of the present invention to provide such supports which are readily adjustable.

It is a still further preferred object to provide an assembly for building construction which saves time, and thereby saves money; reduces the need to tie dowel bars to the steel/mesh; and provides safer working conditions and a safer worksite.

Other preferred objects of the present invention will become apparent from the following description.

In one aspect, the present invention resides in a mounting assembly for a dowel sleeve arranged for engagement with a building construction plate (as hereinbefore defined), the construction plate having a body with at least one hole of non-circular profile there-through;

the mounting assembly being provided at or adjacent one end of the body of the dowel sleeve & including:

a first flange on the body of the dowel sleeve, of non-circular profile, configured to be inserted through one of the holes in the body of the construction plate, and operable to engage an outer face of the body of the construction plate when inserted through the one hole; and a second flange on the body of the dowel sleeve, spaced from the first flange, configured not to be inserted through the one hole in the body of the construction plate, operable to engage an inner face of the body of the construction plate, and having a major axis non-aligned with a major axis of the first flange; so arranged that:

in use, the first flange is inserted through the one hole and the body of the dowel sleeve is rotated so that the first and second flanges engage the outer and inner faces, respectively, of the body of the construction plate to secure the one end of the body of the dowel sleeve to the body of the construction plate.

The spacing between the first and second flanges may, preferably, be just less, to just more, than the wall thickness of the body of the construction plate. More preferably, the spacing is not greater than the thickness, so that friction between the flanges/faces will allow ready rotation at installation but oppose any relative rotation which would allow release of the dowel sleeve from the construction plate.

Preferably the major axes of the first and second flanges are at 90 degrees to each other; but the acute angle between the major axes may be in the range of 5 to 90 degrees.

The non-circular holes may have an infinite range of regular or non-regular profiles. The regular profiles may include, inter alia, triangles, rectangles (including squares), pentagons, hexagons, octagons or other n-sided polygonal shapes; ellipses (including frustrated-ellipses); stars; crosses; or the like. The non-regular profiles may include key-like or ogival profiles, arrows, zigzag profiles or the like.

The first and second flanges may have the same profiles, where the respective dimensions of the second profile are greater than the dimensions of the first flange (and of the one hole(s)).

In use, the first flange is aligned with, and then inserted through the one hole until the second flange engages the inner face of the body of the construction plate. The body of the dowel sleeve is rotated through e.g. 5-90 degrees until the first flange engages the outer face of the body of the construction plate and cannot be withdrawn through the one hole.

In a second aspect, the present invention resides in an assembly for building construction including:

a building construction plate (as hereinbefore defined), having a body with at least one hole of non-circular profile there-through; and at least one dowel sleeve, having a mounting assembly as hereinbefore described at one end of the body of the dowel sleeve, the mounting assembly of the or each dowel sleeve being operably engaged with the body of the construction plate.

In a third aspect, the present invention resides in a support leg for a dowel sleeve, the dowel sleeve having a hollow body open at a second end (preferably spaced from a one end of the body connectable to a construction plate (as hereinbefore defined));

the support leg including:

a base member engagable with a support surface;

a leg member extending upwardly (in use) from the base member; and a spigot, at a distal (or upper) end of the leg member, extending substantially perpendicular thereto, and operable to be inserted into the hollow body of the dowel sleeve (preferably, at the second end thereof).

Preferably, the configuration of the spigot, in end elevation, is complementary to the interior profile of the hollow body of the dowel sleeve at, or adjacent, the second end thereof. The spigot may be e.g. of rectangular (including square), circular, cruciform, or other suitable configuration.

Preferably, the external dimensions of the spigot, in end elevation, are equal to, or just greater than, the corresponding dimensions of the interior profile of the second end of the hollow body so that the spigot will restrained against accidental, or inadvertent, release from the hollow body.

Preferably, the leg member has an abutment face or member to engage the exterior profile of the hollow body of the dowel sleeve at or adjacent the second end thereof.

Preferably, the abutment face or member is spaced below the spigot a distance substantially equal, or just greater than, the wall thickness of the second end of the hollow body.

The leg member may incorporate a plurality of interconnected, but detachable, segments, each segment having a respective base member.

By detaching one or more segments, the effective height of the leg member is adjustable.

Preferably, the, or each, base member is of a plate- or disc-like configuration, and may be of circular, rectangular (including square), hexagon, other regular-polygon, or irregular shape, in plan view.

In a fourth aspect, the present invention resides in a dowel sleeve having the mounting assembly, as hereinbefore described, at one end of a hollow body and a support leg, as hereinbefore described, engaged with the second end of the hollow body.

In a fifth aspect, the present invention resides in an assembly for building construction as hereinbefore described with respect to the second aspect, where the, or each, dowel sleeve is provided with a leg support as hereinbefore described.

BRIEF DESCRIPTION OF THE DRAWINGS

To enable the invention to be fully understood, preferred embodiments of the present invention will now be described with reference to the accompanying drawings, in which.

DETAILED DESCRIPTION OF THE PREFERRED EMBODIMENTS

Figure 1:
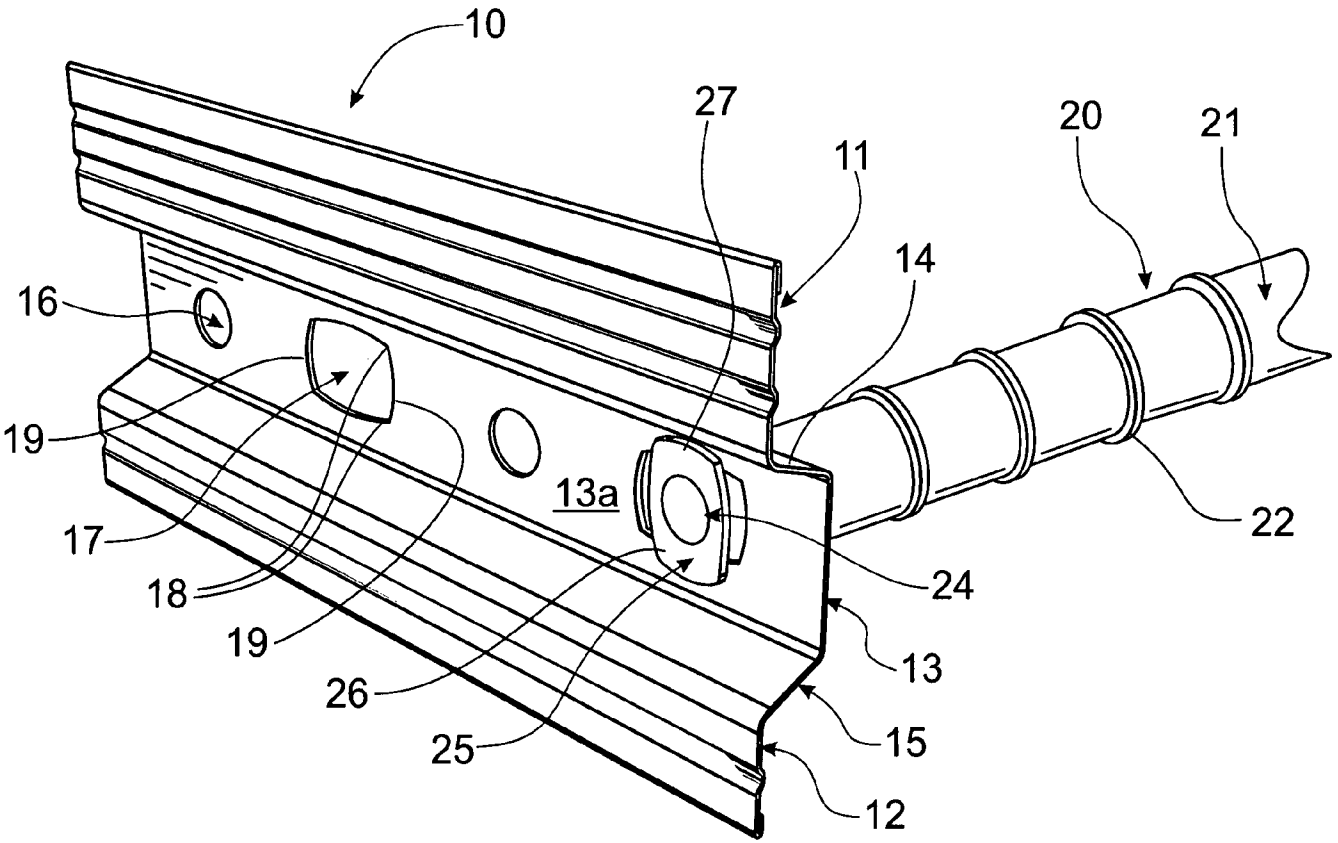
FIG. 1 is a perspective view of a dowel sleeve, provided with a Mounting assembly in accordance with the present invention, engaged with a key joint plate.

Referring to FIGS. 1 to 4, the key joint plate 10 has substantially co-planar vertical top and bottom sections 11, 12, interconnected to a rearwardly spaced central section 13 by rearwardly-convergent upper and lower inclined sections 14, 15.

The key joint plate 10 may be located and supported by stakes (not shown) in the manner disclosed in AU-B-36515/89 (604612) (PAUL F. CONNOLLY et al) and AU 200037928 B2 (730480) (PAUL FRANCIS CONNOLLY et al).

NB: The method of locating and supporting the key joint plate 10 does not form part of the present invention.

Circular holes 16 are provided at regular spacing along the central section 13 to allow dowels (not shown) to pass there-through and to be received in conventional dowel sleeves (not shown).

Intermediate the circular holes 16, non-circular holes 17 are provided at regular spacing, where each of the non-circular holes 17 have a profile hereinafter referred to as a "frustrated-ellipse", where curved top and bottom walls 18 are interconnected by curved end walls 19. (The term "frustrated-ellipse" has been used as it is a profile formed when the respective ends of an ellipse, along its major axis, are cut short or "frustrated".)

Preferably, the circular holes 16 and non-circular holes 17 are opened by the removal of respectively shaped "knock-out-plates"—not shown. The "knock-out-plates" allow the workers to install the dowel sleeves 20 at the required spacing along the key joint plate 10; and the intact "knock-out-plates" prevent concrete flowing through the key joint plate 10 as the concrete in a slab cures.

In the embodiment illustrated in FIGS. 1 to 4, the dowel sleeve 20 has a hollow body 21 of elongate/cylindrical configuration. As will be described hereinafter with reference to FIGS. 5 to 7, the hollow body 21 may be of other suitable configuration, e.g., square or hexagon, in end view.

In the embodiment illustrated in FIGS. 1 to 4, peripheral reinforcing flanges 22 are provided at (preferably equal) spacing along the hollow body 21, to resist the hydraulic pressure of the surrounding concrete when the dowel sleeve 20 is embedded in the concrete slab (as the concrete sets).

Figure 2:
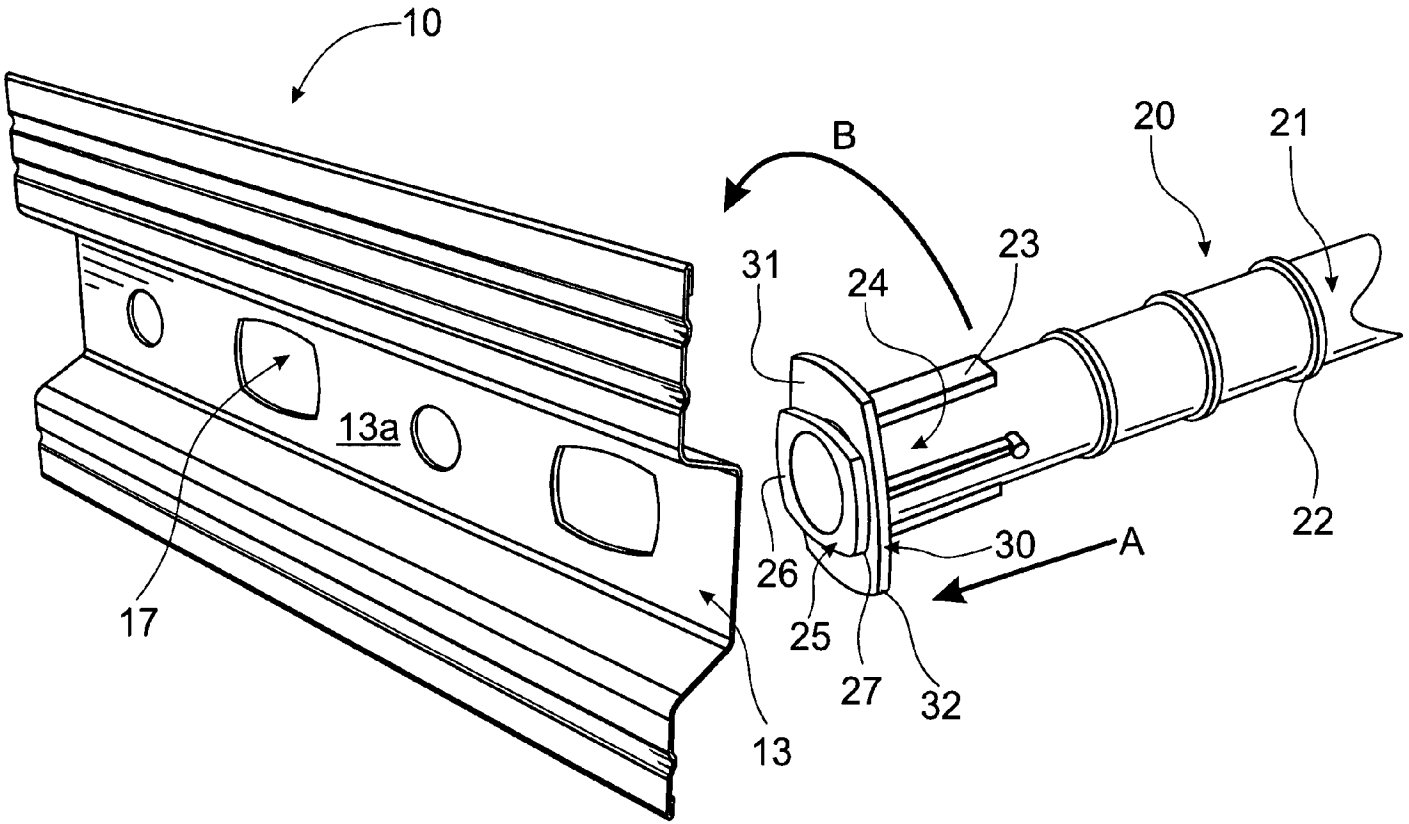
FIG. 2 is an "exploded" view corresponding to FIG. 1.
Figure 3:
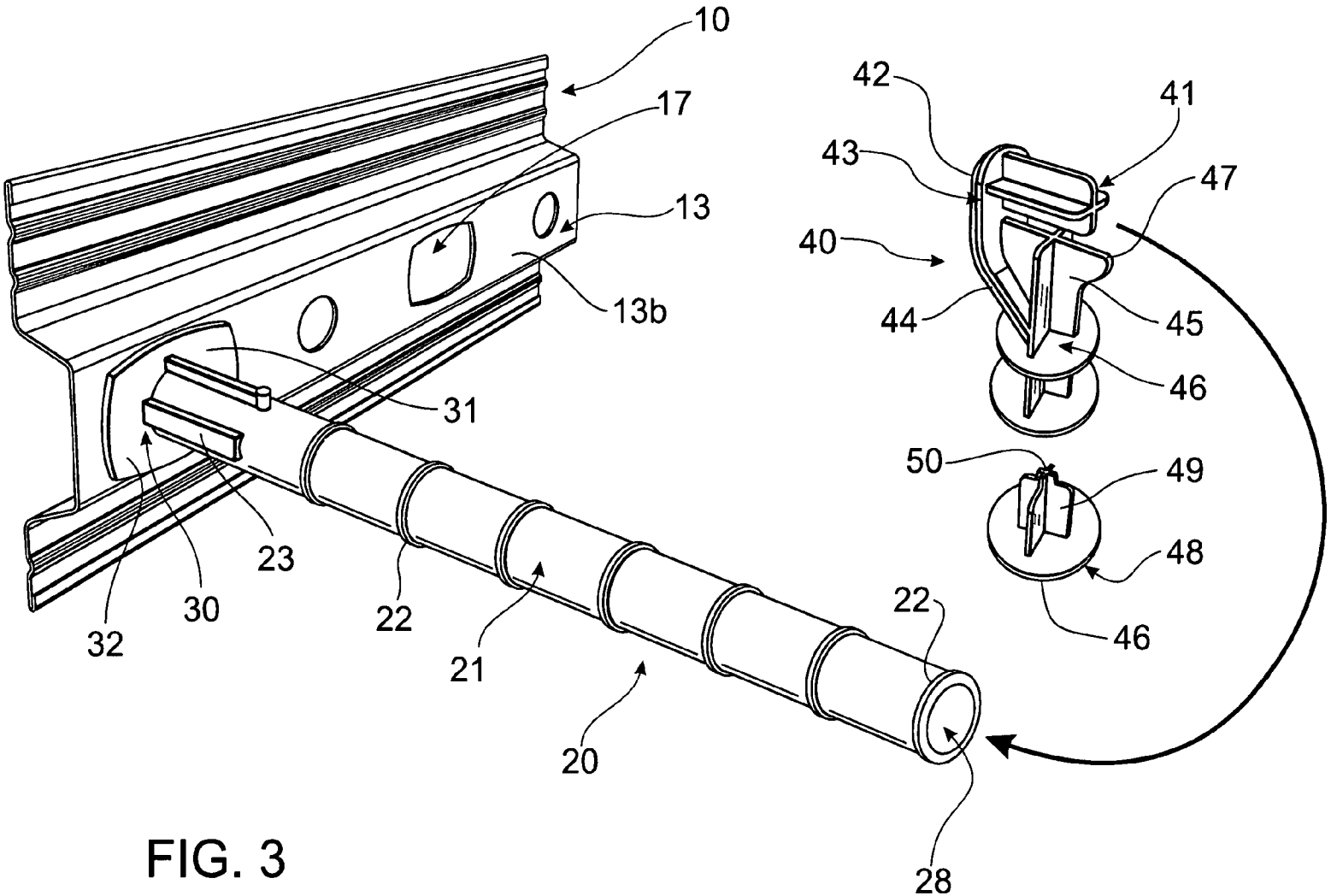
FIG. 3 is a perspective view, from the opposite side, further showing a support leg, in accordance with the present invention, prior to connection to the dowel sleeve of FIGS. 1 & 2.
Figure 4:
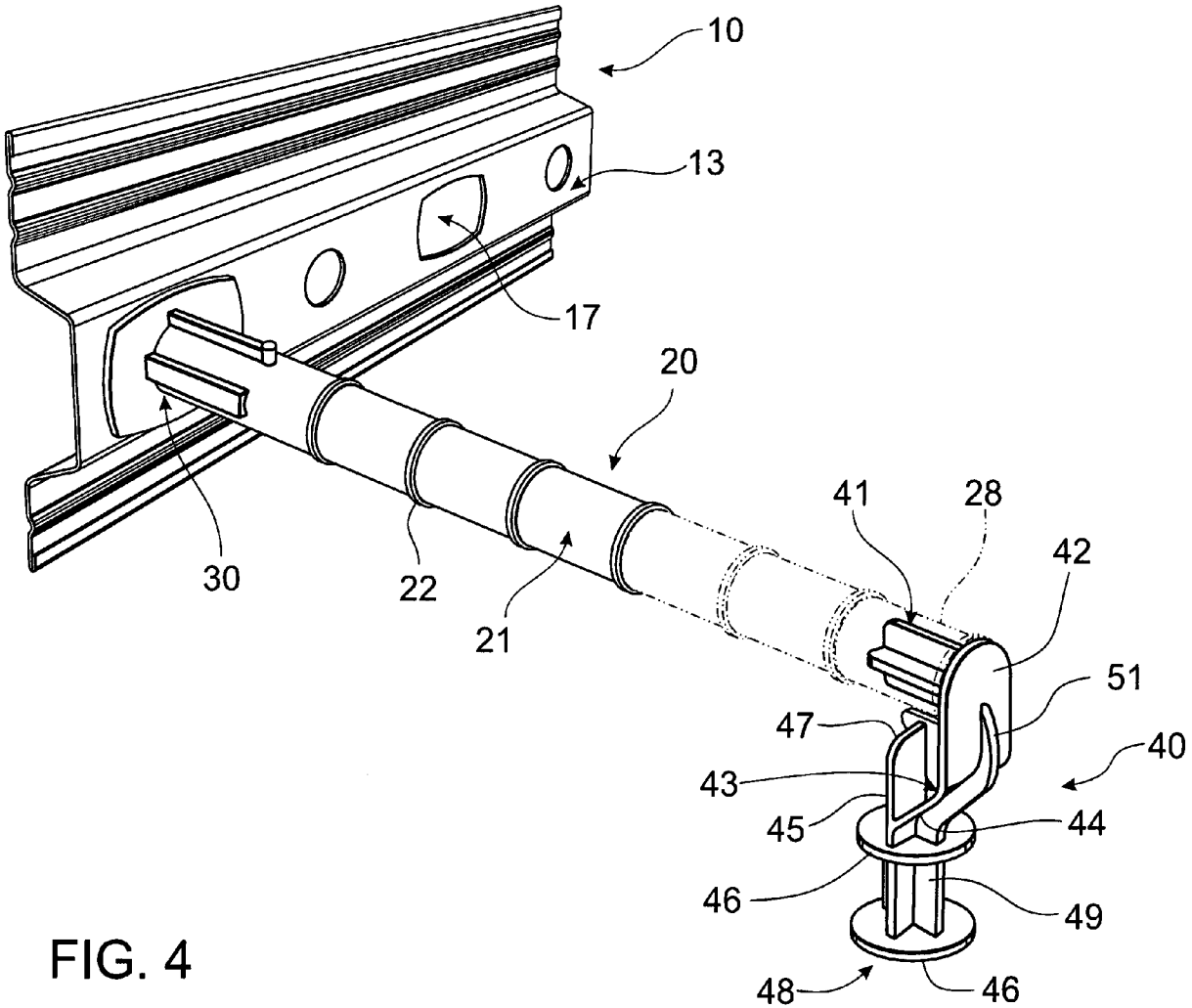
FIG. 4 is a similar view to FIG. 3, where a portion of the hollow body of the dowel sleeve is shown in dashed lines to illustrate the connection of the leg support to the dowel sleeve.

As shown in FIGS. 2 to 4, radially-extending reinforcing flanges 23 may be provided at spaced locations around the one (or outer) end 24 of the hollow body 21 of the dowel sleeve 20.

A first flange 25 is provided at the one end 24 of the hollow body 21, and has a profile corresponding to, but dimensionally smaller, than the non-circular holes 17 in the key joint plate 10. It will be noted that the first flange 25 can be inserted, and pass through, one of the non-circular holes 17, when their respective profiles are substantially aligned; but that the respective "wings" 26, 27 of the first flange 25 will engage the outer face 13*a* of the central section 13 of the key joint plate 10 as shown in FIG. 1.

A second flange 30 is provided on the hollow body 21 of the dowel sleeve 20, spaced a small distance from the first flange 25; where the distance between the first and second flanges 25, 30 is preferably equal to, or just less than, the wall thickness of the central section 13 of the key joint plate 10.

The second flange 30 has a similar profile to that of the first flange 25; but is of larger overall dimension; and has its major axis provided at substantially right angles to the major axis of the first flange 25. (Preferably, the dimensions of the second flange 30 are greater than the dimensions of the non-circular holes 17 in the key joint plate 10 so that, when the dowel sleeve 20 is connected to the key joint plate 10, cement cannot pass through the non-circular hole 17 to which the dowel sleeve 20 is connected.)

To connect the one (or outer) end 24 of the hollow body 21 of the dowel sleeve 20 to the key joint plate 10, the first flange 25 is substantially aligned with a corresponding non-circular hole 17 in the key joint plate 10 and advanced in the direction of arrow A until the second flange 30 engages the inner face 13*b* of the central section 13 of the key joint plate 10.

The dowel sleeve 20 is rotated through 90°, e.g., in the direction of arrow B, so that the "wings" 26, 27 of the first flange 25 engage the outer face 13*a* of the central section 13, to prevent withdrawal of the dowel sleeve 20 from connection with the key joint plate 10.

The wings 31, 32 of the second flange 30 engage the inner face 13*b* of the central section 13, around the periphery of the non-circular holes 17 to prevent concrete passing through the non-circular holes 17.

The skilled addressee will readily appreciate that the mounting assemblies on the hollow bodies 21 of the dowel sleeves 20, when combined with the non-circular holes 17 in the central section 13 of the key joint plate 10, provide a simple, yet quick and efficient means to accurately align and securely (and stably) connect the dowel sleeves 20 at selected locations along the key joint plate 10.

In addition, apart from the need for any tool(s) to remove the "knock-out-plates" for the non-circular holes 17 (e.g., a hammer and chisel), the workmen do not require any other tools or special skills to effect the connection of the dowel sleeves 20 to the key joint plate 10.

FIGS. 3 and 4 illustrate a leg support 40 operable to support the second (or inner) end 28 of the hollow body 21 of the dowel sleeve 20; where a peripheral reinforcing flange 22 is provided at the second end 28 of the hollow body 21.

The provision of the peripheral reinforcing flanges 22 at (preferably equal) spacing along the hollow body 21 enables the dowel sleeve 20 to be cut to length to suit the particular intended application, while enabling the (new) second end 28 to be reinforced against collapse due to the hydraulic pressure of the concrete, and to also minimise any damage thereto during the installation of the dowel sleeve 20.

The leg support 40 has a spigot 41 of substantially cruciform configuration in end view, where the "diametrical" dimensions of the spigot 41 are preferably just greater than the internal diameter of the hollow body 21 of the dowel sleeve 20.

The spigot 41 extends substantially horizontally (in use) from a substantially vertical (in use) upper portion 42 of the leg member 43, the lower portion 44 of the leg member 43 being formed integrally with a substantially cruciform portion 45 of the leg member 43, extending upwardly from disc-like base member 46.

The cruciform leg portion 45 forms an abutment surface 47 spaced below the spigot 41 a distance (preferably) substantially equal to the thickness of the peripheral reinforcing flange 22 at the second end 28 of the dowel sleeve 20. (Preferably, the peripheral reinforcing flange 22 is received in frictional engagement between the spigot 41 and the abutment surface 47.)

To enable the height of the leg support 40 to be adjustable, the leg member 43 is provided with, in this embodiment, two detachable leg member segments 48, where each has a leg portion 49 of cruciform configuration and a disc like-base member 46. (The skilled addressee will appreciate that three, four or more leg member segments may be provided, e.g. of 25 mm height, to provide a wide range of height adjustment (s) for the leg support 40.)

The leg member segments 48 are moulded integrally with the leg member 43 and are interconnected thereto by breakable connection portions 50.

Preferably, each leg member segment 48 has an effective height of e.g. 25 mm; while preferably, the vertical distance between the centre-line of the spigot 41 and the disc-like base member 46 on leg member 43 is e.g. 50 mm. This enables the leg support 40 to support the second end 28 of the dowel sleeve 20 at "modular" spacing above the support surface (e.g., ground) on which the, or the lowermost, base member 46 is placed; and it will be readily apparent to the skilled addressee that the number of leg member segments 48 may be increased to enable the leg supports 40 to support the dowel sleeves at a wider range of heights. The leg supports 40 may be provided in a range of lengths, e.g. 100 mm, 125 mm, 150 mm and 200 mm.

A reinforcing rib 51 is preferably provided on the leg member 43 to provide increased strength in the vertical direction for the leg support 40.

The leg supports 40 are preferably (injection) moulded from suitable plastics material, including polyethylene, polypropylene, PVC or the like. (The material is preferably the same as the material used to produce the dowel sleeves 20.)

The leg support 40 is suitable for a dowel sleeve 20 which has a hollow body 21 of cylindrical configuration.

Figure 7:
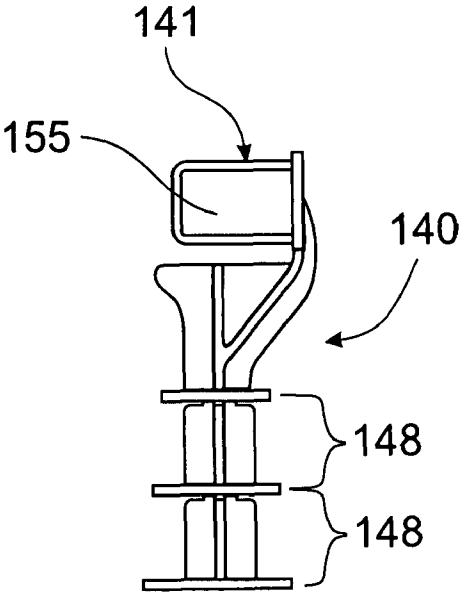
FIGS. 6 and 7 are respective front and side views of the leg support of FIG. 5.
Figure 6:
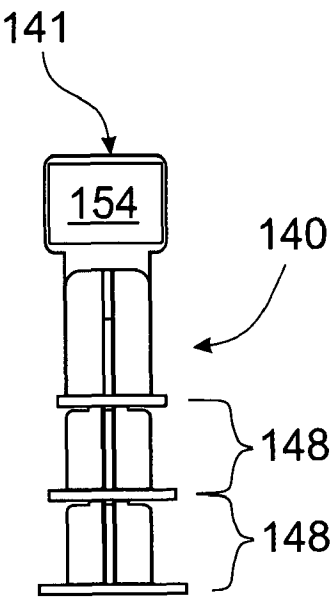
Figure 5:
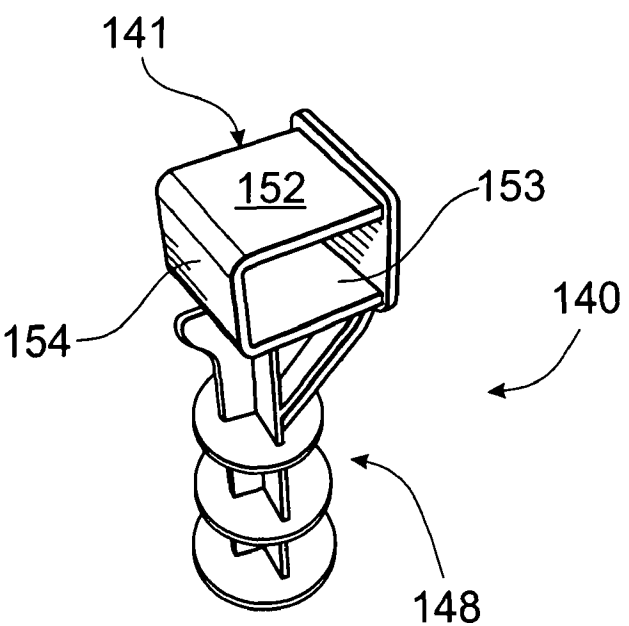
FIG. 5 is a perspective view of an alternative leg support, for use with a dowel sleeve (not shown) with a hollow body of rectangular profile in end view.

FIGS. 5 to 7 illustrate an alternative leg support 140, where the spigot 141 is of rectangular cross-section in front view—see FIG. 6—for engagement in the hollow body (not shown) of a dowel sleeve of substantially rectangular configuration in end view. All of the other features of the leg support 140 are identical, or very similar to, the features of the leg support 40 (of FIGS. 3 and 4), where leg member segments 148 may be removed to enable the effective height of the leg support 140 to be adjusted to suit the particular intended application.

To minimise the volume of plastics required to mould the spigot 141, the spigot 141 has substantially horizontal (in use) top and bottom walls 152, 153, interconnected by a substantially vertical (in use) front wall 154.

A reinforcing rib 155 is provided within the "cavity" defined by the walls 152-154 and is provided on the central axis of the spigot 141.

The embodiments hereinbefore described and illustrated are directed to the connection of one or more dowel sleeves 20 to a key joint plate 10.

Figure 8:
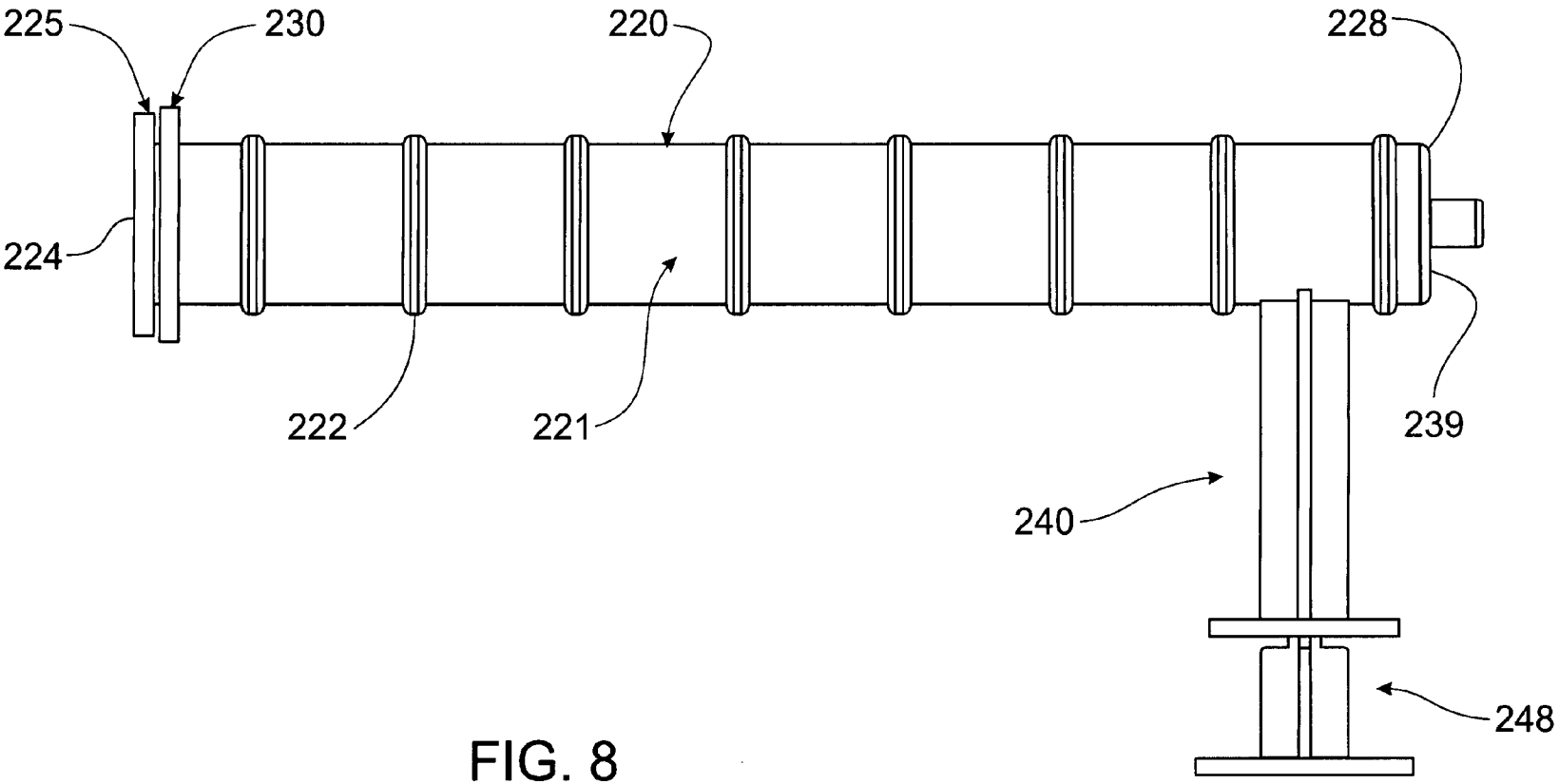
FIGS. 8 and 9 are respective side and perspective views of a dowel sleeve, with an integral support leg, but with the mounting assembly, for use with a contraction or expansion plate and/or timber or steel formwork.
Figure 9:
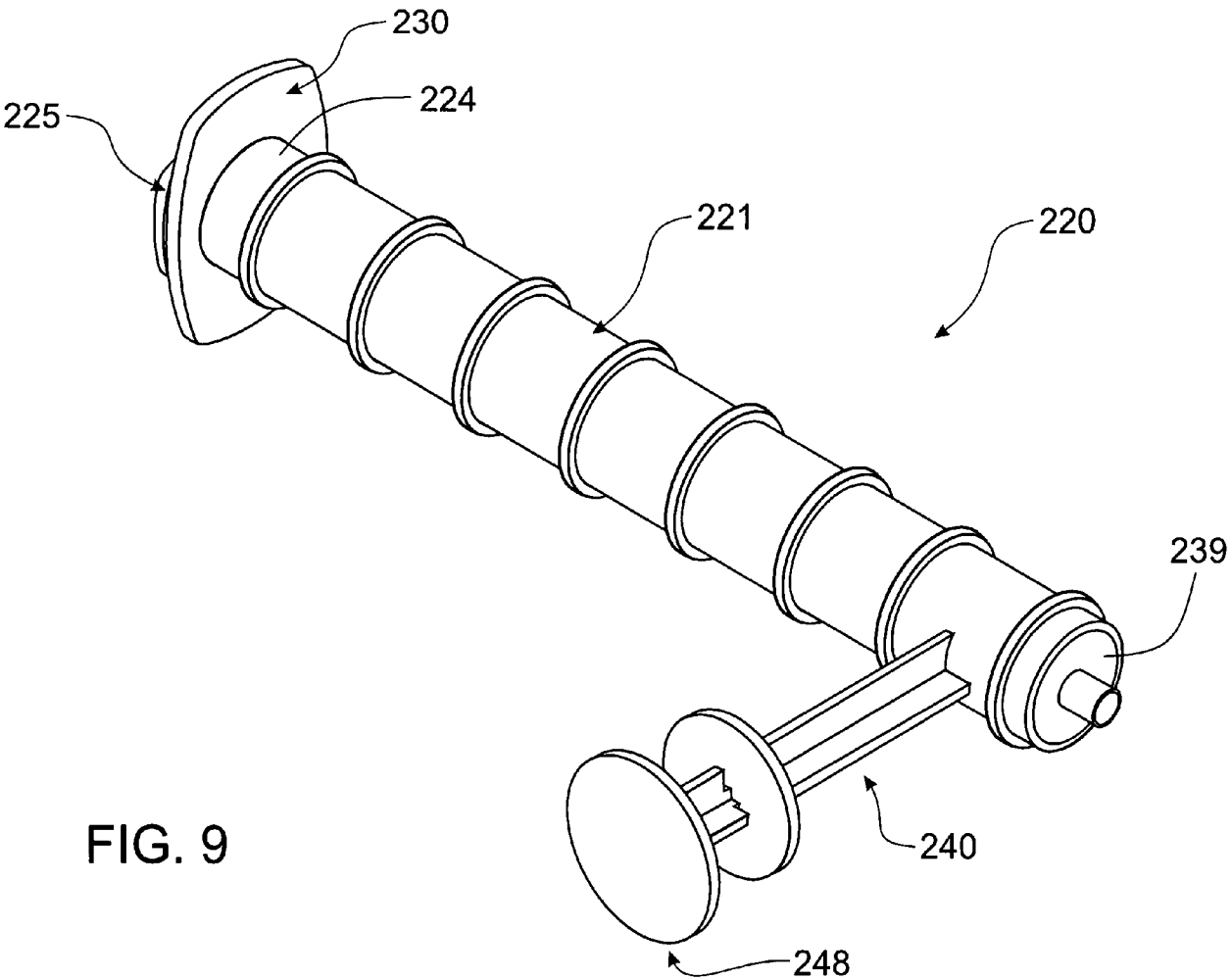

FIGS. 8 and 9 illustrate an alternative dowel sleeve 220 for use with a contraction or expansion plate (and/or timber or steel formwork) (not shown), the plate being provided with spaced, non-circular holes of the type illustrated at 17 in FIGS. 1 to 4.

The dowel sleeve 220 has a hollow body 221, with spaced peripheral reinforcing flanges 222, substantially as hereinbefore described with reference to the dowel sleeve 20. The second end 228 of the hollow body 221 is closed by an integral end cap 239.

The dowel sleeve 220 has an integral leg support 240, with at least one detachable leg member segment 248 of the type hereinbefore described with reference to leg member segments 48, 148 for the leg supports 40, 140.

The one end 224 of the hollow body 221 of the dowel sleeve 220 is provided with first and second flanges 225, 230, arranged as for the flanges 25, 30 of the dowel sleeve 20, for engagement with the non-circular holes in the contraction or expansion plate in the manner hereinbefore described for the key joint plate 10 and dowel sleeve 20.

As hereinbefore described, the one end 24 of the hollow body 221 may be mounted to a timber- or plastics-material contraction or expansion sheet by a complementary mounting plug (not shown), nailed or otherwise fixed to the contraction or expansion plate. The mounting plug may have a base plate engagable with the inner face of the contraction or expansion plate; and the base plate may have, e.g., notches or markings to assist in the alignment of the base plate with the non-circular holes in the contraction or expansion plate.

Each size dowel sleeve, with its complementary leg support and/or mounting plug, may be moulded of plastics-material of a particular colour to denote a dowel sleeve of a particular hollow body configuration, e.g., cylindrical or rectangular, and/or of particular dimensions (e.g., 25 mm diameter). By moulding the complementary components of the same colour, it assists the workmen in quickly identifying which components match and can be used together; and if any required components may be missing. In addition, it also provides for visual inspections by engineers from a "safe" distance, if required, on site.

It will be readily apparent to the skilled addressee that the present invention provides many advantages over the existing dowel sleeves, their mounting to the building construction plates, and/or the support and alignment of the dowel sleeves during installation and pouring of the concrete slabs.

Various changes and modifications may be made to the embodiments described and illustrated without departing from the present invention.

What is claimed is:

1. A support leg for a dowel sleeve, the dowel sleeve having a hollow body open at a second end spaced from a one end of the body connectable to a construction plate, the support leg including:

a base member engagable with a support surface;

a leg member extending upwardly, in use, from the base member; and a spigot, at a distal, or upper, end of the leg member, extending substantially perpendicular thereto, and operable to be inserted into the hollow body of the dowel sleeve, at the second end thereof, wherein the leg member has an abutment face or member to engage an exterior profile of the hollow body of the dowel sleeve at, or adjacent, the second end thereof, the abutment face or member being spaced below the spigot a distance substantially equal, or just greater than, a wall thickness of the second end of the hollow body.

2. A support leg as claimed in claim 1, wherein:

the spigot has a configuration, in end elevation, complementary to an interior profile of the hollow body of the dowel sleeve at, or adjacent, the second end thereof; and the spigot is of rectangular, square, circular or cruciform configuration.

3. A support leg as claimed in claim 2, wherein:

external dimensions of the spigot, in end elevation, are equal to, or just greater than, the corresponding dimensions of the interior profile of the second end of the hollow body, so that the spigot will be restrained against accidental, or inadvertent, release from the hollow body.

4. A support leg as claimed in claim 1, wherein:

the, or each, base member is of a plate- or disc-like configuration, and is of circular, rectangular, square, hexagon, other regular-polygon, or irregular shape, in plan view.

5. A support leg for a dowel sleeve, the dowel sleeve having a hollow body open at a second end spaced from a one end of the body connectable to a construction plate, the support leg including:

a base member engagable with a support surface;

a leg member extending upwardly, in use, from the base member; and a spigot, at a distal, or upper, end of the leg member, extending substantially perpendicular thereto, and operable to be inserted into the hollow body of the dowel sleeve, at the second end thereof, wherein:

the leg member incorporates a plurality of interconnected, but detachable, segments, each segment having a respective base member, so arranged that by detaching one or more segments, the effective height of the leg member is adjustable.

6. A dowel sleeve, having a hollow body open at a second end spaced from a one end of the body connectable to a construction plate, provided with a support leg, as claimed in claim 5, engaged with the second end of the hollow body.

7. A support leg according to claim 5, wherein:

the spigot has a configuration, in end elevation, complementary to an interior profile of the hollow body of the dowel sleeve at, or adjacent, the second end thereof; and the spigot is of rectangular, square, circular or cruciform configuration.

8. A support leg according to claim 7, wherein:

external dimensions of the spigot, in end elevation, are equal to, or just greater than, the corresponding dimensions of the interior profile of the second end of the hollow body, so that the spigot will restrained against accidental, or inadvertent, release from the hollow body.

9. A support leg according to claim 5, wherein:

the, or each, base member is of a plate- or disc-like configuration, and is of circular, rectangular, square, hexagon, other regular-polygon, or irregular shape, in plan view.

* * * * *